US007882953B2

(12) United States Patent
Heller et al.

(10) Patent No.: US 7,882,953 B2
(45) Date of Patent: Feb. 8, 2011

(54) PACKAGE WITH A LOCKING SLEEVE

(75) Inventors: Joel Heller, Islandia, NY (US); David Heller, Islandia, NY (US)

(73) Assignee: Printex Packaging Corporation, Islandia, NY (US)

( * ) Notice: Subject to any disclaimer, the term of this patent is extended or adjusted under 35 U.S.C. 154(b) by 1001 days.

(21) Appl. No.: 11/641,547

(22) Filed: Dec. 18, 2006

(65) Prior Publication Data

US 2008/0142397 A1 Jun. 19, 2008

(51) Int. Cl.
*B65D 21/00* (2006.01)

(52) U.S. Cl. ..... 206/499; 229/125.19; 229/125.125; 229/128; 229/125.32; 220/8; 53/458

(58) Field of Classification Search ..... 229/128, 229/125.125, 125.32, 125.28, 125.19, 100–102; 220/8; 206/499; 53/458
See application file for complete search history.

(56) References Cited

U.S. PATENT DOCUMENTS 1,076,156 A * 10/1913 Schierse ..... 229/101
1,959,649 A * 5/1934 Trogman ..... 229/125.28
2,412,402 A * 12/1946 Huye ..... 229/125.26
2,435,355 A * 2/1948 Ingram, Sr. ..... 229/125.28
2,827,222 A * 3/1958 Buttery ..... 229/101
2,970,742 A * 2/1961 Fleisig ..... 229/125.28
3,051,366 A * 8/1962 Sandstrom ..... 229/125.125
3,709,402 A * 1/1973 Templeton et al. ..... 221/33
3,727,825 A * 4/1973 Troth ..... 229/153
D472,808 S 4/2003 Gelardi et al.
D472,809 S 4/2003 Gelardi et al.
D472,810 S 4/2003 Gelardi et al.
7,000,775 B2 2/2006 Gelardi et al.
2005/0247578 A1 11/2005 Gelardi et al.

* cited by examiner

*Primary Examiner*—Tri M Mai
(74) *Attorney, Agent, or Firm*—Sills Cummins & Gross P.C.

(57) ABSTRACT

A clear package for storing a packaged product and providing an easy locking mechanism to seal and secure the product. The package of the present invention has a sleeve having foldable tabs at the top and bottom, and a top and bottom opening, and a slidable insert having indents at the top and bottom, the slidable insert being slidably inserted into the sleeve through the top or bottom opening, where the tabs align with the indents to provide a locking mechanism, and where the height of the sleeve is substantially the same as the height of the slidable insert.

11 Claims, 4 Drawing Sheets

PACKAGE WITH A LOCKING SLEEVE

BACKGROUND OF THE INVENTION

1. Field of the Invention

The present invention relates generally to the field of product packaging, and more specifically, to product containers having a slidable insert and a sleeve.

2. Prior Art

Product packaging serves a number of different functions, including: protecting the packaged product from accidental damage, attractively displaying the packaged product, and for preventing theft or tampering. In addition, it is desirable for a package to be as inexpensive to manufacture as possible.

In the prior art, heat, tape and glue can be used for product packaging which can be slow and expensive. End caps or plugs are often used that need to be sealed, glued or taped to the package in order to provide tamper evidence. In other instances, the packaging requires rigid, generally inflexible and relatively costly plastic, and often has relatively complex latching means and can require excess manual labor in order to install the item being packaged, such as watches, clocks and other items having cosmetic appeal.

Therefore, there is an ongoing need in the packaging industry for new package designs, which provide for protection of the packaged product, for attractively displaying the packaged product, for providing an inexpensive latching means to seal or close the package, and for providing a secure package for a product for theft and tamper protection.

SUMMARY OF THE INVENTION

The present invention provides for packaging which firmly and securely holds its contents in place, but does not require an additional fastening means, such as tape or other fastening means for securing the package components together.

The present invention further provides packaging which can be closed in a secure manner and provides a tamper evident package.

The present invention also provides packaging for displaying items, which items can be packaged in a fast and efficient manner.

The present invention also provides an attractive package which displays its contents in an appealing fashion and which can be closed manually without the use of adhesive tape or other closing means.

Accordingly, a package is provided, comprising a sleeve having one or more foldable tabs and an opening, and a slidable insert having one or more indents, the slidable insert being inserted into the sleeve through the opening, wherein the one or more foldable tabs align with the one or more indents, providing a locking mechanism, and wherein the height of the sleeve is substantially the same as the height of the slidable insert.

The sleeve can have a top opening and a bottom opening, and there can be two foldable tabs on a top side of the sleeve and two foldable tabs at a bottom side of the sleeve. The foldable tabs can have a notch that provides a spring-back feature of the tab. There can further be two indents at a top side of the slidable insert and two indents at a bottom side of the slidable insert. The two indents at the top side of the slidable insert can align with the two foldable tabs at the top side of the sleeve, and the two indents at the bottom side of the slidable insert can align with the two foldable tabs at the bottom side of the sleeve.

The slidable insert can have a top and bottom covering and enclose a product. The indents are preferably recessed into a thickness of a wall of the slidable insert. The sleeve and slidable insert are preferably made of a material comprising a see-through plastic material. The see-through plastic material can be chosen from any material known in the art, such as polyvinyl chloride (PVC), polyethylene terephthalate (PET), polypropylene (PP) or polystyrene (PS). The sleeve can be cut and the tabs scored, so that the tabs of the sleeve spring back once the sleeve is formed and the tabs are folded. The slidable insert can be vacuum formed.

Further, a method is provided for packaging a product, the method comprising positioning a product inside a slidable insert, the slidable insert having one or more indents, sliding the insert into an opening of a sleeve, the sleeve having one or more foldable tabs, and locking the slidable insert into the sleeve by aligning the one or more indents with the one or more foldable tabs, wherein the height of the sleeve is substantially the same as the height of the slidable insert.

Also provided is a method of manufacture of a product package, the method comprising cutting one or more panels to create a sleeve, scoring one or more foldable tabs located at a top and bottom of the panels, folding the one or more tabs inward, securing the panels together to form the sleeve, and sliding a slidable insert into the sleeve, the slidable insert having a height substantially the same as the height of the sleeve.

The method of manufacturing a product package further comprises inserting a product within the slidable insert before sliding the slidable insert into the sleeve. The method further comprises locking the slidable insert into the sleeve by securing the one or more foldable tabs into one or more indents on the slidable insert.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE INVENTION

Figure 1:
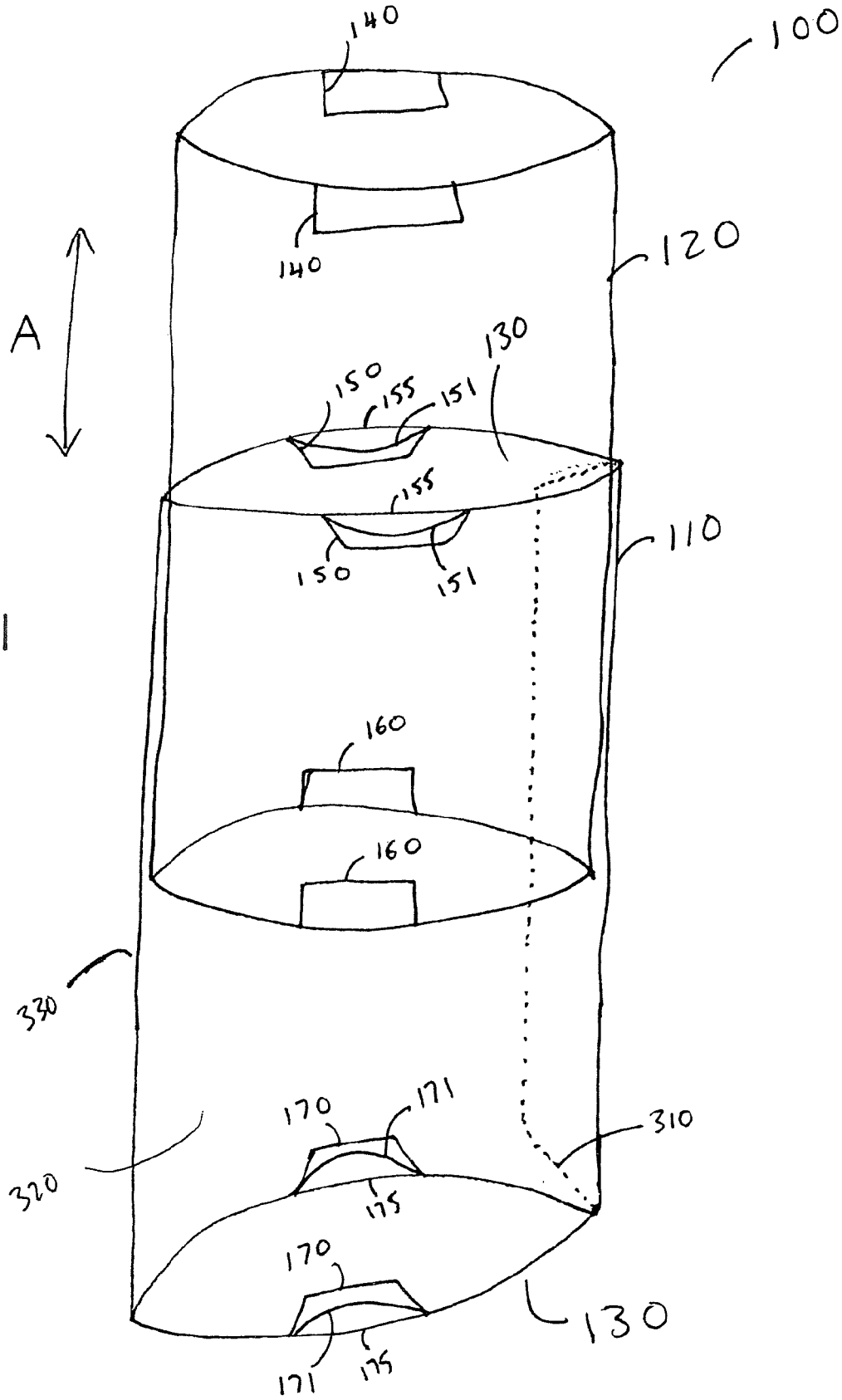
FIG. 1 illustrates a front view of a slidable insert and a sleeve of a package in accordance with an embodiment of the present invention.

With reference to FIG. 1, the product package 100 comprises two components, a sleeve 110 and a slidable insert 120. The sleeve 110 has an opening 130 on a top side and a bottom side. The sleeve 110 further has foldable tabs 150 on a top side, and foldable tabs 170 on a bottom side. The foldable tabs 150 can be opposite each other, and the foldable tabs 160 can be opposite each other. The sleeve 110 is made of two panel walls 320 and 330, as will be further explained below. The foldable tabs 150 and 160 are folded into the openings 130, and are preferably folded 180 degrees inward. Foldable tabs 150 are foldable along an edge 155, and foldable tabs 170 are foldable along edges 175.

The slidable insert 120 has top indents 140 on a top side, and bottom indents 160 on a bottom side. The top indents 140 preferably are opposite each other and the bottom indents 160 are preferably opposite each other, as shown in FIG. 1. The indents 140, 160 are recessed into the thickness of a wall of the slidable insert 120. The slidable insert 120 has a solid top covering and a solid bottom covering, and can enclose a product (not shown). The slidable insert 120 can be used to hold any type of product inside of it (not shown), such as but not limited to jewelry, cosmetics, perfumes, etc. The sleeve 110 and the slidable insert 120 can be fabricated from a sheet of plastic material known in the art, such as polyvinyl chloride (PVC), polyethylene terephthalate (PET), polypropylene (PP) or polystyrene (PS), or can be made of a paper material, as would be known in the art.

Foldable tabs 150 on the sleeve 110 each have notches 151, and foldable tabs 170 each have notches 171. The notches 151, 171 are indentations on the tabs 150, 170, respectively, which are formed by scoring the tabs during manufacture of the package, as will be further explained below. Scoring the notches 151 and 171 provide a "spring-back" feature of the tabs, so after the tabs 150, 170 are folded into the openings 130, the tabs 150, 170 "spring-back" so they fit securely into the indents 140, 160, respectively.

The slidable insert 120 is manufactured to a size that allows the slidable insert 120 to have a secure fit inside the sleeve 110. The slidable insert 120 is vacuum formed or pressure formed. In the vacuum form process a thermoplastic sheet is heated and stretched over a mold.

The thickness of the sleeve 110 and the slidable insert 120 can be selected based on a number of factors, including price and strength. The sleeve 110 can be thick enough to provide structural support, but thin enough to allow the sleeve to be flexed and folded. The slidable insert 120 can similarly be thick or thin, as may be required to hold a product inside of it.

The slidable insert 120 slides inside the sleeve 110 as shown in FIG. 1, and can move in an up and down direction A as shown. The size of the slidable insert 120 is slightly smaller than the size of the sleeve 110, so that the slidable insert 120 freely slides within the sleeve 110, but is also securely held in place. The slidable insert 120 is inserted all the way to fit securely within the sleeve 110.

The foldable tabs 150 at the top of the sleeve 110 fit within indents 140 of the slidable insert 120, and the foldable tabs 170 at the bottom of the sleeve 110 fit within indents 160 of the slidable insert 120, to provide a type of locking mechanism. The foldable tabs 150, 170 can be the same shape as the indents 140, 160, to provide a tighter locking feature and for ensuring a permanent lock.

Figure 2:
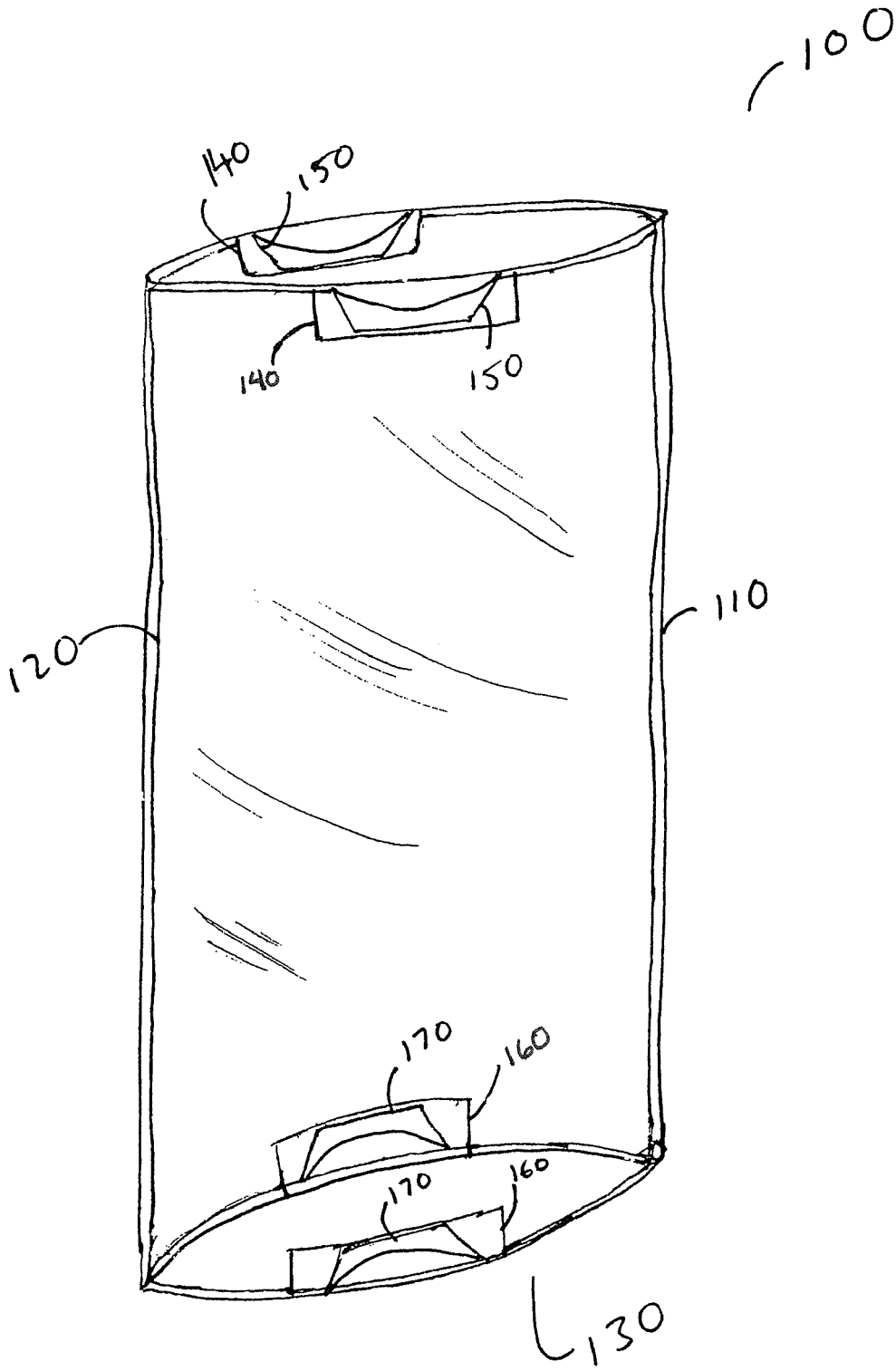
FIG. 2 illustrates a perspective view of a package in accordance with an embodiment of the present invention.

As seen in FIG. 2, the slidable insert 120 fits inside the sleeve 110. The height of the slidable insert 120 is substantially the same as the height of the sleeve 110, so that when the slidable insert 120 is slid down all the way, it appears as one product package 100. The product inside the slidable insert 120 is visible through the see-through plastic material of the sleeve 110 and slidable insert 120. The foldable tabs 150 at the top side of the sleeve 110 fold into the top indents 140 of the slidable insert 120, and the foldable tabs 170 at the bottom side of the sleeve 110 fold into the bottom indents 160 of the slidable insert 120. Once positioned as such, the slidable insert 120 is locked into place by the locking mechanism of the foldable tabs 150, 170 and indents 140, 160. Thus, the slidable insert 120 does not move in an upward direction (blocked by tabs 150 and indents 140), and does not move in a downward direction (blocked by tabs 170 and indents 160). Thus, the present invention provides a secure and theft-proof package for a product.

The operation of the locking mechanism is now described with respect to an exemplary package and exemplary fabrication technique. It will be apparent that the described product package and fabrication technique may be modified without departing from the spirit of the invention.

Figure 3:
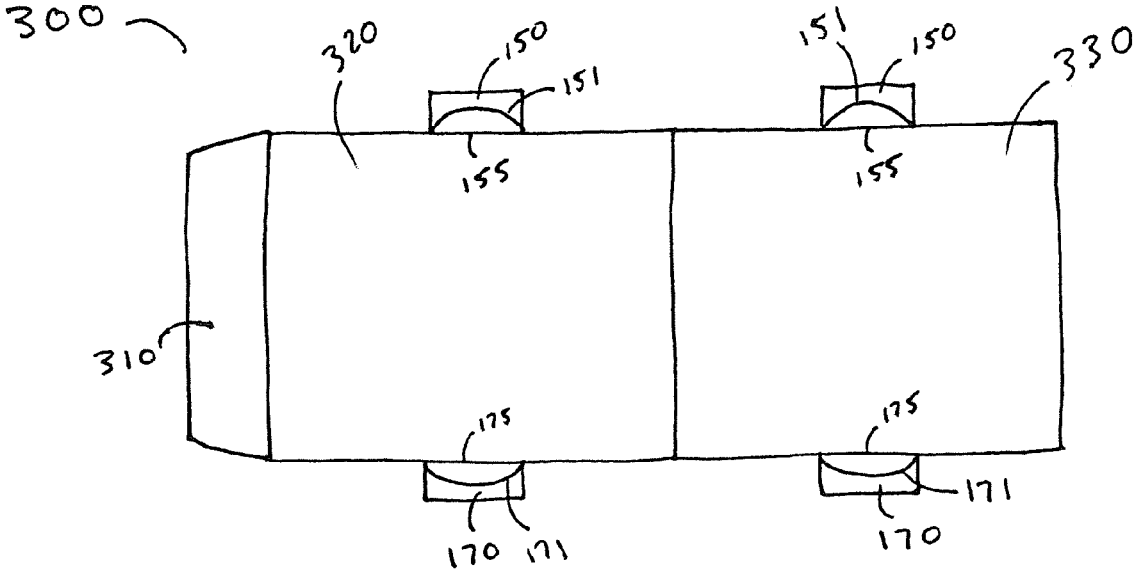
FIG. 3 illustrates a plan view of a blank for fabricating a sleeve in accordance with an embodiment of the present invention.

FIG. 3 shows a plan view of a blank 300 for forming a sleeve according to an aspect of the invention. The blank 300 is die cut from a sheet of suitable material, such as PVC, PET or other suitable material. If desired, textual or graphic matter may be printed directly onto the blank using a high-speed printing process.

The blank 300 includes a first panel 320 and a second panel 330 that are folded towards each other to form the body of the finished sleeve 110. A glue flap 310 extends outward from the first panel 320, and is used to attach the outside edges of the first and second panels 320 and 330 to each other. Extending from the top side of each of the first and second panels 320 and 330 is a foldable tab 150. The foldable tabs 150 are foldable along a foldable edge 155. Foldable tabs 170 extend from the bottom side of the first and second panels 320 and 330. Each of the foldable tabs 170 have a foldable edge 175, about which the tabs 170 fold. The foldable tabs 150 have notches 151 and 171, which are explained below.

In the manufacturing process, first the panels 320, 330, the glue flap 310 and tabs 150, 170 are cut out. Then, the tabs 150, 170 and are scored by providing notches 151, 171, respectively, such that when the tabs 150, 170 are folded inward, the tabs retain some memory. Thus, once the tabs 150 and 170 are folded inward, the tabs will partially return or flair back towards their original unfolded position. This "spring back" effect created by the scoring technique applied to the tabs causes the tabs to lock effectively with the indents on the slidable insert.

The foldable tabs 150 and 170 are shown as rectangular in shape, but can also be square, trapezoidal, triangular, round, oval, elliptical, cubed, pillow packed, semi-circular, or any other shape found to work. Other shapes may be used for the foldable tabs 150, 170 and the shapes are not limited to the above. Further, the indents can be shaped to match the shape of the tabs to ensure a permanent lock, but are not required to be. Thus, the indents may have any of the shapes as described above for the tabs.

In fabricating a finished sleeve from the blank 300, the first panel 320 is folded along the border of the glue flap 310 and the panel 320. Then, the second panel 330 along the border of the first panel 320 and the second panel 330. The second panel 330 is then folded over the glue flap 310, and a suitable technique is employed to cause the glue flap 108 to adhere to the second panel 330. Any suitable adhesive can be used to bond the glue flap 310 to the second panel 330 for bonding the material of the blank 300. Preferably, a see-through plastic material is used and an clear adhesive is used so as to not be seen through the see-through material. The bonding of the glue flap 310 to the second panel 330 creates a sleeve with openings at the top and bottom of the blank 300. When the second panel 330 is folded over the first panel 320, foldable tabs 150 will line up with foldable tabs 170. However, other orientations for the foldable tabs 150 and 170 may also be used without departing from the spirit of the invention, as will be seen below.

Figure 4:
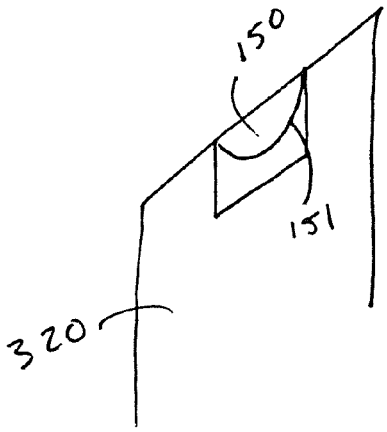
FIGS. 4(*a*) and 4(*b*) illustrate locations of tabs for different embodiments of the sleeve in accordance with the present invention.
Figure 4:
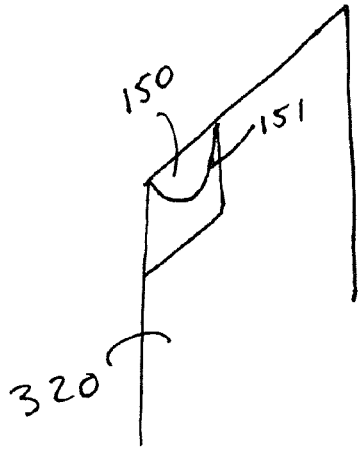

In FIG. 4(*a*), the foldable tab 150 is provided for at a top middle of the first panel. Accordingly, when a slidable insert 120 is used, the slidable insert 120 will have its indents along a top middle of its panels as well, so that the indents 140 and foldable tabs 150 are aligned, and the indents 160 and foldable tabs 170 align for the locking mechanism to work. However, in another embodiment in FIG. 4(*b*), the foldable tab 150 is provided for at the top edge of the first panel 320, and can also be located at the top edge of the second panel 330. Accordingly, the slidable insert 120 will also have indents 160 along the top edges so that the indents and tabs are aligned for the locking mechanism to function properly. Therefore, the location of the tab is not as critical as the need for the foldable tabs and indents to be aligned in order to ensure the locking mechanism described above functions properly.

Figure 5A:
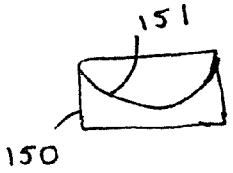
FIGS. 5(*a*)-5(*c*) illustrate different notches for the tabs for different embodiments of the sleeve in accordance with the present invention.
Figure 5B:
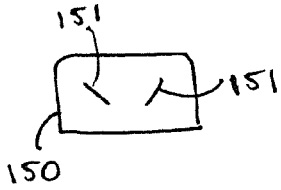
Figure 5C:
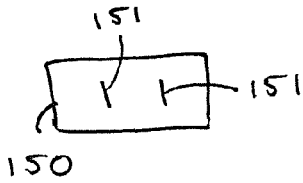

Further, the scoring feature is not limited to any shape, as shown in FIGS. 5(*a*)-5(*c*). The notch 151 can be a curve, as shown in FIG. 5(*a*). The notches 151 can also be as provided for in FIGS. 5(*b*) and 5(*c*). The notches can be one notch on each tab, more than one notch on each tab, different shapes and designs and are not limited to the above. What is essential is that a notch is provided (indentation) using a scoring technique when fabricating the sleeve, which provides the spring-back feature.

Depending on the dimensions of the finished sleeve 110, it would be possible for a worker to hold the sleeve 110 in one hand, using the thumb and fingers to apply pressure to the side edges 115 of the sleeve 110. The worker could then pop the sleeve 110 open, and use the other hand to install a slidable insert 120 into an opening 130 on a top side or bottom side of the sleeve 110. The product is placed inside the slidable insert 120 before being slid through either opening 130. The above described manual operations may also be performed by machine. Once the package 100 has been loaded and closed, it would be almost impossible to open the package without destroying or breaking the tabs.

The present product package provides several advantages that solve the problems with prior art packages. Unlike other packages, the product package 100 provides a package that is easily and quickly locked, that provides a high degree of security for the product packaged. It further provides a clear material so that the product can be viewed clearly. The package is inexpensive, simple and easy to manufacture, where the product can be quickly and securely locked into the package.

The spring back effect created on the tabs of the sleeve permit the foldable tabs to engage with an inexpensive vacuum formed insert. The locking mechanism does not rely on the thickness of the panel/tab material to engage with the indents on the insert. Instead, the panels rely on the spring back action of the tabs to engage the indents of the slidable insert. This extra tolerance allows the present invention to lock more consistently than the prior art inventions. In the prior art, a slight variation in the manufacturing process of the sleeves and end caps could result in the failure of the locking feature. This is evidenced by the additional wafer seals often applied to the molded end caps and sleeves in the prior art in order to ensure security and tamper evidence. This results in additional time and costs that are not necessary in the present invention.

The present invention allows for ease of assembly. The sleeves are shipped flat with the locking tabs pre-folded. The product to be packaged can be pre-loaded off line into the vacuum formed slidable insert, and the insert with the product can be inserted into the sleeve. The insert is guided so that the pre-folded tabs on the sleeve fit into the corresponding indents on the insert. This procedure can be performed by either hand or machine.

The set up and tooling costs are substantially less than the alternatives. No injection molded end caps are required, and the parts used for the package of the present invention are significantly less costly compared to the lead times and high costs for injection molds. The present invention is cost effective for small runs as well as large. In addition, tooling costs associated with sonic and RF welding processes are not required.

The sleeve and slidable insert easily slide together for efficient filling. The slidable insert can be pre-loaded and inserted into the sleeve by hand or machine. This is significant as other prior art solutions require end caps or plugs that cannot be easily machine assembled with standard equipment. The sleeve and slidable insert of the present invention can be manufactured easily with standard equipment that is readily available.

Furthermore, the present invention takes up less space in inventory. The sleeve can lay flat and the slidable insert can be nested which require less warehouse space for storage. The more efficient use of space results in lower storage, handling and transportation costs versus alternative packaging. The fact that there is only two components needed (sleeve and slidable insert) versus three components in the prior art (sleeve, bottom end cap and top end cap) also reduces inventory management costs. There is one less stock keeping unit (SKU) that needs to be managed.

The above descriptions of the present invention are specific embodiments of the present invention and are not limited to the above descriptions and uses. Various other uses are also possible, in which the product package can be made of any material, and is not limited to a paper or plastic material. The indents and foldable tabs can be of any shape, such as rectangular, square, round, oval, elliptical, trapezoidal, semi-circular, triangular, etc. The shape of the indents and foldable tabs can be similar to provide a locking mechanism that fits the foldable tabs and indents securely. The sleeve and slidable insert are not limited to an oval shape as shown in the figures, but can be a square, rectangular, triangular, or any other shape, without departing from the scope of the present invention. Further, the location of the indents and foldable tabs can be varied along the top of the slidable insert and sleeve, respectively. The sleeve and insert are extremely versatile and can be used for many difference packages, sizes and display styles.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A package comprising:

a sleeve having one or more foldable tabs on a top side of the sleeve, one or more foldable tabs on a bottom side of the sleeve and an opening;

a slidable insert having one or more indents on a top side of the slidable insert and one or more indents on a bottom side of the slidable insert, the slidable insert being insertable into the sleeve through the opening;

wherein the one or more indents on the top side of the slidable insert align with the one or more foldable tabs on the top side of the sleeve, and the one or more indents on the bottom side of the slidable insert align with the one or more foldable tabs on the bottom side of the sleeve, providing a locking mechanism;

wherein the height of the sleeve is substantially the same as the height of the slidable insert.

2. The package of claim 1, wherein the sleeve has a top opening and a bottom opening.

3. The package of claim 1, comprising:

two foldable tabs on a top side of the sleeve and two foldable tabs on a bottom side of the sleeve.

4. The package of claim 3, comprising:

two indents on a top side of the slidable insert and two indents on a bottom side of the slidable insert.

5. The package of claim 1, wherein the slidable insert has a top and bottom covering and encloses a product positioned within the insert.

6. The package of claim 1, wherein the indents are recessed into a thickness of a wall of the slidable insert.

7. The package of claim 6, wherein the sleeve and slidable insert are made of a material comprising a plastic material.

8. The package of claim 7, wherein the plastic material is chosen from one of the following materials: polyvinyl chloride, polyethylene terephthalate, polypropylene and polystyrene.

9. The package of claim 1, wherein the one or more foldable tabs each have a notch that provides a spring-back feature of the tab.

10. The package of claim 1, wherein a shape of the one or more foldable tabs on the sleeve corresponds to a shape of the one or more indents on the slidable insert.

11. A method of packaging a product, the method comprising:

positioning a product inside a slidable insert, the slidable insert having one or more indents on a top side of the slidable insert and one or more indents on a bottom side of the slidable insert;

sliding the insert into an opening of a sleeve, the sleeve having one or more foldable tabs on a top side of the sleeve and one or more foldable tabs on a bottom side of the sleeve; and locking the slidable insert into the sleeve by aligning the one or more indents with the one or more foldable tabs;

wherein the height of the sleeve is substantially the same as the height of the slidable insert.

* * * * *